United States Patent [19]

Lowther

[11] Patent Number: 4,619,225

[45] Date of Patent: Oct. 28, 1986

[54] APPARATUS FOR STORAGE OF COMPRESSED GAS AT AMBIENT TEMPERATURE

[75] Inventor: Frank E. Lowther, Buffalo, N.Y.

[73] Assignee: Atlantic Richfield Company, Los Angeles, Calif.

[21] Appl. No.: 146,634

[22] Filed: May 5, 1980

[51] Int. Cl.[4] ..... F02B 43/08

[52] U.S. Cl. ..... 123/3; 123/536; 55/75

[58] Field of Search ..... 123/3, 567, 536, 539; 55/75, 33, 74; 206/0.6, 0.7

[56] References Cited

U.S. PATENT DOCUMENTS 3,033,642 5/1962 Bukata et al. ..... 55/75
3,164,454 1/1965 Wilson ..... 55/75
3,602,202 8/1971 Kobayashi ..... 123/537
4,094,652 6/1978 Lowther ..... 55/33

FOREIGN PATENT DOCUMENTS 1258658 1/1968 Fed. Rep. of Germany ..... 123/536

*Primary Examiner*—E. Rollins Cross
*Attorney, Agent, or Firm*—Drude Faulconer

[57] ABSTRACT

The present invention includes methods and apparatus wherein large volumes of normally cryogenic gases, like oxygen and nitrogen, can be safely stored as "quasi-liquids" at room temperatures. The dangers and hazards normally associated with the storage of highly compressed gases are greatly reduced by the invention. A gas adsorbing material fills the containing vessel and, thereby, limits the maximum rate at which gas can leave the vessel.

5 Claims, 24 Drawing Figures

APPARATUS FOR STORAGE OF COMPRESSED GAS AT AMBIENT TEMPERATURE

BACKGROUND OF THE INVENTION—I

Many everyday processes depend upon expendable input materials normally in the gas phase. Automobiles, for example, depend upon oxygen normally extracted from the atmosphere, as needed, by compression in the engine cylinders. Compression is known to be energy expensive and subtracts from the useful shaft output from the engine. Significant engine performance improvements are available if the oxygen needed for combustion could be supplied by a stored source mounted with the engine. In other applications for internal combustion engines, stored oxygen, rather than atmospheric oxygen, must be used if the engine is to run at all. A submerged submarine with no snorkel must rely upon a stored source of oxygen if its Diesels are to be run. Otherwise, the electric engines must be used while the craft is submerged. Stored oxygen has been used for both automobile and submarine service where the oxygen is stored as a cryogenic liquid, a compressed gas, or as a chemical compound with available oxygen (i.e., hydrogen peroxide). All three methods have their advantages and problems. Compressed oxygen requires a heavy containing vessel that faces safety problems of fracture. Cryogenic oxygen requires expensive vacuum jacketed vessels that provide only limited protection from long term boil-off. Storage as a chemical with available oxygen presents problems of corrosion and safety (nitric acid, ammonium nitrate, hydrogen peroxide, etc.).

Oxygen for welding purposes is commercially stored and shipped as both a liquid or highly compressed gas. The same is true for oxygen in hospital service and for laboratory use.

Similar comments apply for nitrogen service. Atmospheric control in long range truck service is important for many applications. Thus, apples being shipped cross country may require a nitrogen rich atmosphere to reduce spoilage. Cryogenic nitrogen on-board the truck will serve this purpose. However, the apparatus necessary to store the cryogenic nitrogen is expensive and provides only a limited "shelf-life" for the stored cryogenic nitrogen.

In many applications, the safety of storing a highly compressed gas is limiting. In submarine service, for example, rupture of a vessel containing a highly compressed gas would mean certain disaster. The same would be true for an airplane application involving storing large amounts of highly compressed gas in the airplane.

The basic problem associated with storing a highly compressed gas is that nothing naturally will slow down the outrushing gas in case of vessel fracture. The potential energy of the compressed gas is released instantaneously and, thus, creates a near-infinite power or rate of energy release. If the outrushing gas can be slowed down, then the safety problem disappears. It is perfectly analogous to the gasoline situation. Burn a gallon of gasoline slowly, say in one hour, and nothing drastic happens. Burn the same gallon of gasoline in one second and a first order explosion will take place. The present invention provides a method and process wherein the maximum rate at which a compressed gas can leave a cylinder is limited by the action of an adsorbant material filling the vessel.

High Pressure Storage of Gases in an Adsorbent Containing Pressure Vessel

BACKGROUND OF THE INVENTION—II

The input raw materials, intermediate products, and final output products from many chemical, physical, and biological processes are gases at the pressures and temperatures involved. The process may include synthesis, analysis, and manufacturing on a laboratory, pilot plant, or mass production scale.

Gases generally are more difficult and expensive to store, handle, and ship, than are solids and liquids. Gases must be stored in closed vessels, whereas liquids and solids need not. Liquids and solids generally are more than 500 times more dense than are gases under normal conditions. For example, water is 785 times more dense than is ambient air. The economic value of a material tends to depend directly upon its mass density. It costs about the same to ship 80,000 pounds of liquid as it does to ship 100 pounds of gas at one atmosphere in similar 10,000 gallon tankers. Therefore, gaseous products must be stored at relatively high pressures in order to achieve the high mass density needed to be competitive.

For a given gas temperature, the mass density of a gas increases directly with gas pressure. A limiting pressure is approached, typically several thousand atmospheres, wherein an additional pressure increase has but negligible effect upon the gas density. The gas molecules can be squeezed only so close together.

The storage of high pressure gas in large amounts is expensive, complex, and hazardous. Consider a cubic pressure vessel, one foot on a side, and charged with a 3000 atmosphere gas. The net outward force on each face is 3180 tons. The potential energy of compression amounts to about 50 million foot pounds or 65,000 Btu's, and is sufficient to vaporize to steam over 8 gallons of water. A sudden rupture of the vessel will result in extensive damage to the surroundings, since the 65,000 Btu's must be dissipated in one way or another.

The high pressures of gas storage are not dangerous in themselves. Thus, gas compressed to 1000 atmospheres and stored in a capillary tube, presents no problem, since there is no total energy or mass involved. The situation is similar to a million volt power supply. If the source impedance is one ohm, then a short circuit at the terminals will violently destroy the apparatus and the building it is in. However, it is safe to grab both terminals of a 1 million volt power supply with 100 billion ohms source impedance.

Few subjects are as extensively covered by codes and regulations as are pressure vessels. Federal, state, and local codes exist for the installation and operation of pressure vessels. Various industries and professional engineering groups have their own strict codes for pressure vessels. Even so, fatal accidents occur frequently in spite of the extensive codes and regulations that have been adopted.

Normally, the reason for storing compressed gas is to make available massive amounts of the particular gas in a reasonably small volume. The potential energy stored as work of compression is often incidental and must be considered a necessary, but hazardous, side effect. That is, the chemical worth of the compressed gas is generally much greater than the worth of the potential energy of compression for the stored gas. Exceptions to this exist, of course. Compressed air in a scuba tank will be utilized at one atmosphere and high pressure is only required to keep the tank size manageable. Compressed air to fill an automobile tire must be at high pressure (3 atmospheres) during its entire useful sojourn. The tank size in the ground at the gasoline station is inconsequential.

The present invention includes methods and apparatus wherein a large amount of gas can be safely stored in a relatively small physical volume at room temperature. The compressed gas containing vessel of this invention is cheaper, safer, and holds more gas per unit of volume than has previously been possible. The present invention involves the use of gas adsorbing solids inside the containing vessel. The classical description of gas adsorption on solid surfaces is not adequate to explain the present invention. In fact, the present invention is a direct result of certain advances made in adsorption theory recently by the inventor. A presentation of these theoretical results will be given in this specification in order to fully illustrate and explain the present invention.

Prior Art Description

Under normal conditions of temperature and pressure, typical liquids are from 500 to 1000 times more dense than are typical gases. Water is 62 pounds per cubic foot, while standard air is about 0.08 pounds per cubic foot. Most materials used in large amounts in the gas phase are highly compressed for economy of shipping and storage. The gas density varies directly with pressure. One pound of oxygen occupies 12 cubic feet at one atmosphere, and one cubic foot at 12 atmospheres. Storage volume and not weight is the problem with gases.

The storage of highly compressed gases can be dangerous if accidents should occur. If the containing vessel or the entrance connections should fracture, then the outrushing gas will cause physical damage to the surroundings in at least two ways. First, the energy and momentum of the escaping gases will tend to make shrapnel out of the fractured vessel. Second, the volume of escaping gas will push back the atmosphere which, in turn, can do physical damage by pushing against building walls and the like.

Consider, for example, a standard welding gas cylinder containing 3 cubic feet of oxygen at a pressure of 3000 psia. The compressed oxygen contains potential energy in the same way as a compressed spring. The oxygen potential energy of compression can be calculated from the following expression:

$$\text{Energy} = P_1V_1 \ln \frac{V_2}{V_1} = P_1V_1 \ln \frac{P_1}{P_2}$$

$$= 3000 \frac{\text{lbs.}}{\text{in.}^2} \times 144 \frac{\text{in.}^2}{\text{ft.}^2} \times 3 \text{ ft.}^3 \ln \frac{3000}{14.7}$$

$$= 6.89 \times 10^6 \text{ ft.-lbs.} = 8837 \text{ Btu.}$$

The oxygen potential energy of compression calculated in the above example is about equivalent to the heating value of ½ gallon of gasoline and is sufficient to vaporize one gallon of water. If suddenly released, the oxygen in the example above would have to dissipate the 8837 Btu's in some fashion or other: tear the metal cylinder or its fittings, accelerate the cylinder itself by a jet effect, knock over walls, impart kinetic energy to small objects in the area, etc. The initial 3 cubic feet of oxygen at 3000 psia pressure will come to rest as 600 cubic feet of oxygen at 14.7 psia.

The amount of potential damage and, therefore, the degree of risk associated with storing compressed gas increases with both vessel size and storage pressure. The tank surface area to enclosed volume decreases with size and, in some ways, tends to moderate the risk, somewhat, at larger tank sizes. In any event, the design of large pressure vessels is an exacting and expensive process and many lives have been lost due to neglect, inadequate safety margins, and the improper use of high pressure gas storage systems.

One common way to reduce the risk of storing compressed gas is to liquify the gas for storing and shipping. Unfortunately, the liquification technique brings with it a new class of problems, since many common gases must be maintained at extremely low temperatures (cryogenics) in order to remain liquid. The containing vessels are expensive and must contain extremely low pressure vacuum jackets. Oxygen and nitrogen both fall into the cryogenic category.

Chemical methods are often used to reduce the problems associated with the storage of compressed gases. For example, oxygen can be combined with water to form the liquid hydrogen peroxide $H_2O_2$. The extra oxygen atom in the hydrogen peroxide molecule is then available, upon demand, for the appropriate chemical reaction. Thus, available oxygen is stored as a liquid at room temperature via the $H_2O_2$ molecule.

In some instances, a gas can be safely stored by being dissolved in a liquid at room temperature. Acetylene is dissolved in acetone and stored in cylinders containing an asbestos matrix.

SUMMARY OF THE INVENTION

The present invention includes methods and apparatus wherein a normally gaseous material can be stored in a "quasiliquid" state and most of the safety problems associated with highly compressed gases have been eliminated or greatly reduced.

It is an object of this invention to remove or greatly reduce the problems associated with storing highly compressed gases by limiting, to acceptably safe levels, the maximum rate at which a highly compressed gas can leave its containing vessel.

It is yet another object of this invention to provide a practical method of storing highly dense, normally gaseous, material without the need for low temperatures, vacuum jackets, nor the risks involved with storing large amounts of highly compressed gas.

It is yet another object of this invention to provide a safe, practical, and efficient method of storing large amounts of oxygen in a relatively small volume for internal combustion and external combustion engine service, wherein the hazards and disadvantages of stored compressed gas and cryogenic liquids are greatly reduced.

It is yet another object of this invention to provide a safe, practical, and efficient method of storing large amounts of air in a relatively small volume for life support purposes: submarines, spacecraft, airplanes, etc.

It is yet another object of this invention to generally store gases in a highly dense state with minimal complications normally associated with the storage of highly compressed gases or cryogenic liquids.

These and other objects and features of the invention will be apparent to a skilled scientist by reference to the following description and drawings.

DETAILED DESCRIPTION—I

Figure 1:
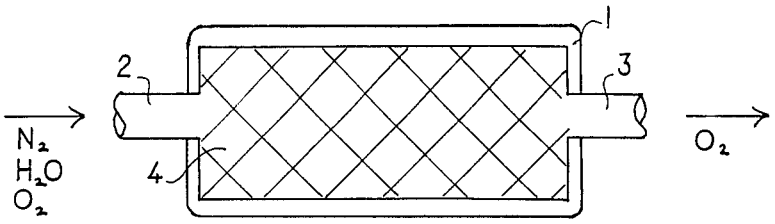
FIG. 1 represents a simple process of air separation by adsorption.

Gas adsorbing materials exhibit ultraporosity where the pores are a few molecular diameters in cross section. The pores may run in random tunnel fashion, as parallel tunnels, etc. The commercial use of adsorbents typically is for gas separation. FIG. 1 shows a simple adsorbent bed including a containing pressure vessel 1 with input gas port 2 and outlet gas port 3 and adsorbing material 4. The entering gas contains nitrogen, oxygen, and water as humidity. The adsorbent 4 selectively adsorbs the nitrogen and water, while the oxygen is free to leave the system at port 3. In effect, the system of FIG. 1 is a simple air separation plant. The chemistry and physics are such that nitrogen and gaseous water molecules enter the pore structure of adsorbent 4 and become electrostatically trapped in the pore structure. In general, the higher the gas pressure and the lower the gas temperature, the more adsorption will take place per unit of adsorbent present. Eventually, the adsorbent bed becomes saturated with nitrogen or water or both and must be regenerated by driving off the adsorbed molecules by heat, application of a vacuum, etc. Generally two beds are used where one is being regenerated, while the other is on stream.

Commercial adsorbents which exhibit ultraporosity and which are generally used for the separation of gas and vapor mixtures include the activated carbons, activated clays, inorganic gels such as silica gel and activated alumina, and the crystalline aluminosilicate zeolites (molecular sieves). The adsorption of a molecule on an adsorbing material takes a finite amount of time, particularly if the adsorbent bed is large and large amounts of adsorbed gases are involved. Just as it takes time to adsorb the gas molecule, it also takes time to desorb the same molecule. It is this finite desorption time that makes the present invention possible. The maximum rate at which a gas can leave a pressure vessel, filled with an appropriate adsorbent, is limited by the desorption process required. Therefore, the outrushing gas warefront is slowed down to levels wherein damage will be minimal. It is important to note that the constraints that determine the characteristics, and hence the cost, size, and complexity of a commercial pressure vessel, are the "what if" constraints. What if a 45 magnum bullet is fired at the tank?. The present invention removes this constraint and danger and, therefore, permits a cheaper, simpler, and less costly pressure vessel to do an equivalent job. If a 45 magnum bullet hits a gas pressure vessel that practices the present invention, then fragmentation of the tank and other physical damage will not occur. What will occur is that the expansion, as the adsorbed gases desorb, will cause a large drop in local temperature. The same heat of adsorption given off when the bed was charged to high pressure will now be adsorbed from the atmosphere and, hence, cool the local bed. In short, the potential energy represented by the compressed, adsorbed gas will, in large part, end up as local cooling. Typically, the heat of adsorption for oxygen on Chabazite (a natural zeolite) is about 4.0 kcal/mole.

It is important to realize that the present invention does not require an adsorbent for any of the classical reasons of gas separation, selective adsorption, gas drying, hydrogen sulfide removal. What is required is merely for the pore structure of an adsorbing material placed in a pressure vessel to slow down gas molecules that are to leave the vessel either under normal operating conditions or under conditions of vessel or fittings failure.

Figure 2:
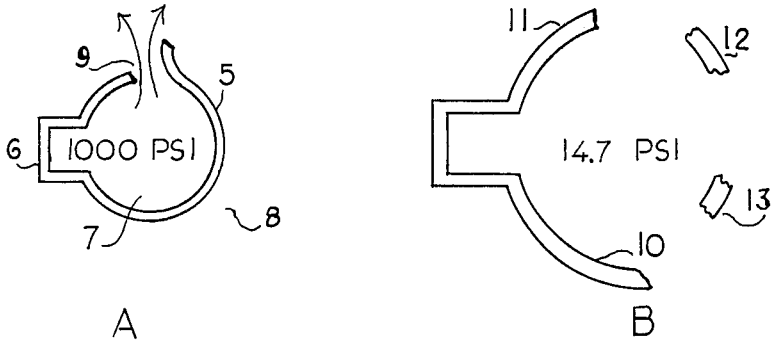
FIGS. 2A and 2B represent the condition when a pressure vessel is fractured under load.

FIG. 2 shows a simple, spherical gas pressure vessel 5 containing gas 7 at 1000 psi pressure and equipped with fitting 6. At t=0 in FIG. 2A, a rupture occurs at location 9 in tank 5. The gases rush out at 9 and two seconds later the situation has changed to that shown in FIG. 2B, where the tank has been bent out of shape 10, 11 and fragments 12, 13 have been generated. The interior pressure has dropped to ambient (14.7 psi).

Figure 3:
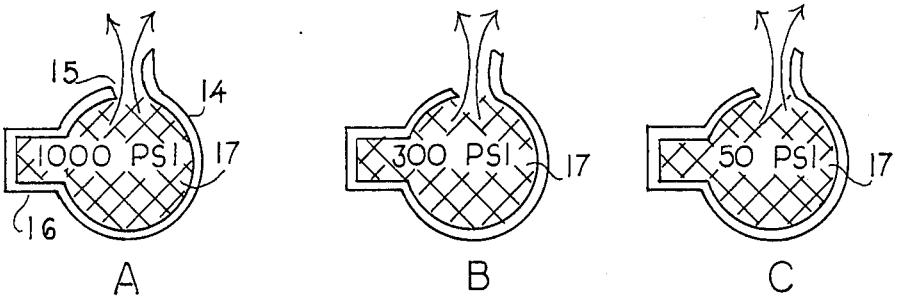
FIGS. 3A, 3B and 3C represent the moderating effect of the present invention upon an otherwise catastrophic fracture of the pressure vessel.

FIG. 3 illustrates the present invention in case of a similar failure of the vessel. In FIG. 3A, pressure vessel 14 with fitting 16 develops a fracture at 15 and the gases start to exit at t=0. FIG. 3B shows the situation one minute later where the adsorbent material 17 has held in some of the air and the pressure has only dropped to 300 psi. FIG. 3C shows the condition existing five minutes after tank rupture. At five minutes, the tank is still in one piece and the gas is still coming out relatively slowly and 50 psi pressure still exists. The adsorbent 17 has slowed down the gas exit to yield energy release rates that can be tolerated by the system.

Figure 4:
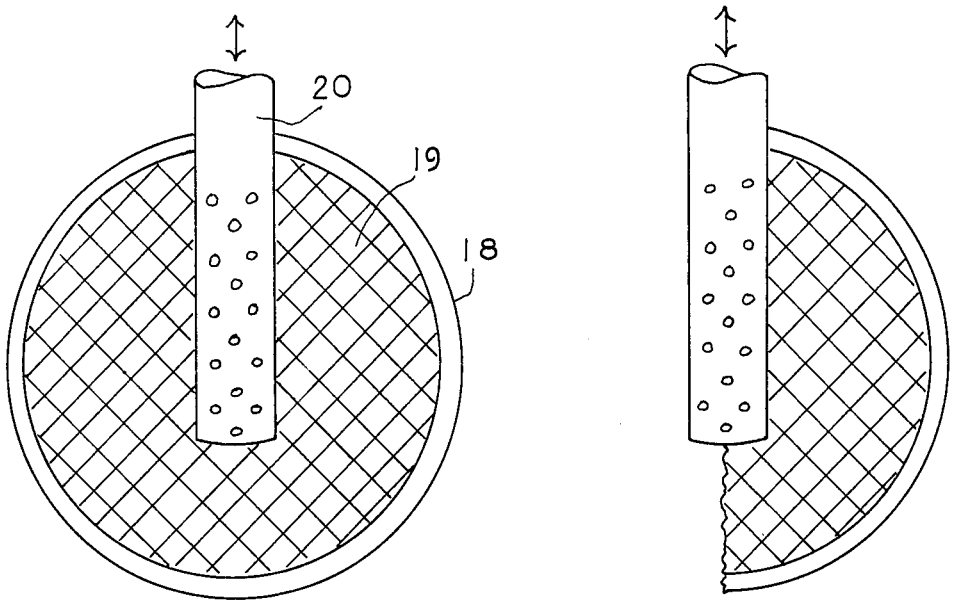
FIGS. 4 and 5 are embodiments of the present invention showing adsorbent materials in the pressure vessels.

The adsorbent material may be cast to fill the pressure vessel as in FIG. 4. Vessel (cylindrical or spherical or other practical shape) 18 is filled with adsorbing material 19 and fitted with a gas charging and draw-out pipe 20. The adsorbent 19 may be any of the common types in commercial use.

Figure 5:
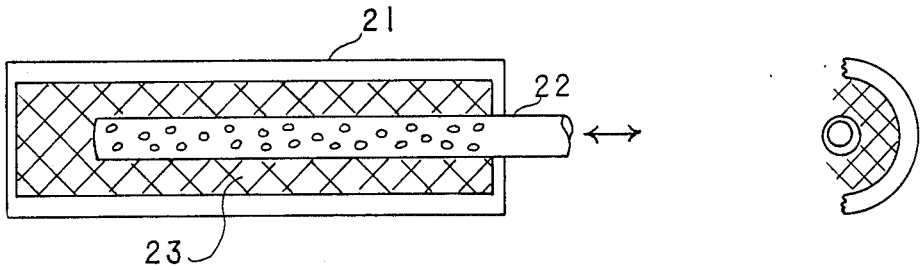

FIG. 5 is the cylindrical version of FIG. 4 and includes pressure vessel 21, adsorbent 23 and input/output pipe 22.

Figure 6:
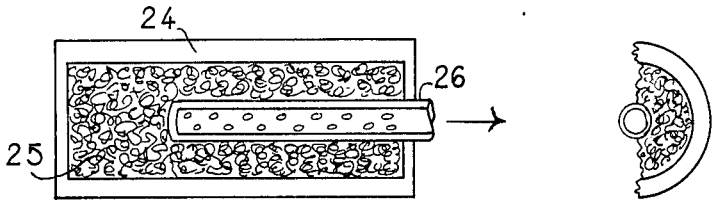
FIG. 6 shows an embodiment of the present invention, wherein the adsorbent is in pellet form.

FIG. 6 shows an embodiment wherein the adsorbent material 25 is in standard commercial pellet form and is contained in pressure vessel 24 equipped with input/output pipe 26.

Figure 7:
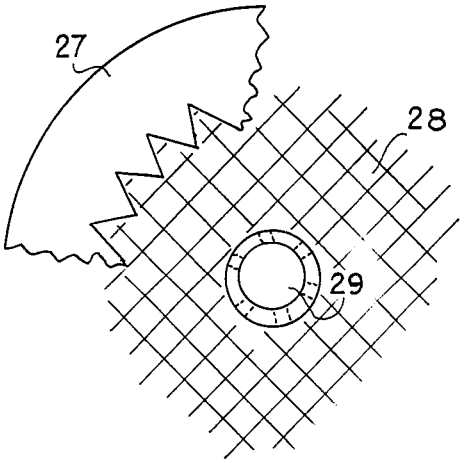
FIG. 7 shows a saw-tooth surface on the vessel wall to cut down gas pockets at the wall-adsorbent interface.

FIG. 7 shows a method of minimizing gas short circuit paths at the adsorbent/vessel wall interface. Vessel wall 27 is manufactured with a saw-tooth surface. The sawtooth surface may be machined, cut in, or may be a separate surface welded to the vessel inner wall. The adsorbent 28 is shown as cast into the vessel and bonded to wall 27 and air input/output tube 29.

Figure 8:
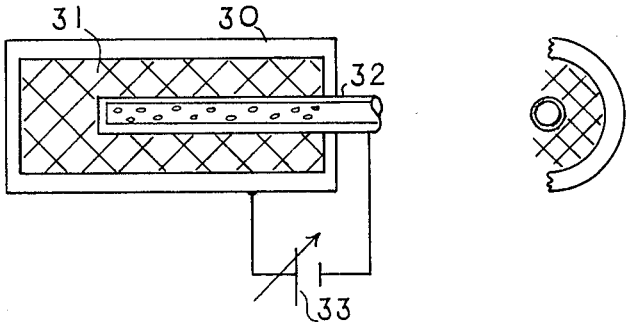
FIG. 8 shows an electrodesorption method to speed up gas exit rate.

In some applications, it will be necessary to draw product gas from the pressure vessel at a rate greater than the adsorbent bed will allow, yet less than a catastrophic rate. This can be achieved by utilizing an electrodesorption process as described in U.S. Pat. Nos. 4,038,050; 4,094,652; 4,101,296 and others (Lowther). In simplified form, the electrodesorption method is shown in FIG. 8. The gas entry tube 32 is electrically conducting, but insulated from the conducting pressure vessel 30 containing adsorbent material 31. A voltage applied, as shown at 33, will tend to drive out adsorbed molecules. The higher the voltage, the higher the desorption rate.

The following examples will illustrate the present invention vis a vis the prior art:

EXAMPLE 1

A commercially available 3 Angstrom (3A) molecular sieve in 1/16 inch pellet form fills a 10 cubic foot pressure vessel. Oxygen at 1000 atmospheres of pressure is admitted and the heat of adsorption removed. Upon measurement, it is found that 150 pounds of oxygen is in the tank when equilibrium occurs 10 minutes after the start of tank charge up. The manufacturer's specification for 3A molecular sieve states an average pore diameter of 3.3 Angstrom and a total pore volume of 0.2 cubic foot per cubic foot of bulk volume. The average oxygen density is calculated to be about 78.0 pounds per cubic foot and is in agreement with the perfect gas law corrected for compressibility factors.

EXAMPLE 2

A one inch military armor piercing shell is shot through the pressure vessel in Example 1. The initial exit of gas is moderate and causes little or no damage. Over five minutes are required for equilibrium to occur and all the gas to leave the tank. A large amount of frost and frozen adsorbent material is noted.

EXAMPLE 3

The same tank of dimensions in Example 1 is tested with the same one inch shell test with no adsorbent in the tank. The pressure vessel instantaneously disintegrates and shrapnel is found over 300 feet away.

EXAMPLE 4

A gas (nitrogen) holding tank of 5000 gallons is filled three-quarters full of 13X molecular sieve. The tank is pressurized to 300 psi and tested with a one inch armor piercing shell fired at the bottom where the sieve is. No violent damage occurs to the structure other than that made by the shell. Over two hours are required for the tank to completely drain of the nitrogen. The same one inch bullet test made on a similar tank with no adsorbent present is different. One-quarter of one side is completely turned to shrapnel.

EXAMPLE 5

A 100 gallon tank is used to store compressed air at 1500 atmospheres. The tank is filled with silica gel particles of $\frac{1}{8}$" average diameter. The weight of adsorbed air is estimated to be over 450 pounds. The pore volume of the silica gel used is 0.31 cubic feet per cubic foot of bulk density. The average pore size is 22 Angstroms. The tank outlet pipe is opened full and it takes 30 minutes for the tank pressure to drop to 5 atmospheres. In a similar test with no adsorbent in the tank, the tank empties completely in 3 minutes. The output fittings limit the flow rate in this case.

EXAMPLE 6

In another example, a standard 2500 psi, two cubic foot oxygen tank for welding use is filled with 13X molecular sieve. It is found that the storage pressure can safely be increased to 7500 psi and, thereby, increase the amount of oxygen stored by about 3 to 1. The fittings have to be strengthened.

Considerable heat of adsorption will be given off when the pressure vessel is initially charged. Charging with cold gas will tend to minimize the problem. It is even possible to charge the vessel with liquified gas and the heat of adsorption can be dissipated by vaporizing the liquid prior to vaporization. It is to be noted that heat of vaporization is very similar to heat of adsorption, since the adsorbed state can be considered to be a liquified state. Heat transfer fins integral to the pressure vessel housing can help the heat of adsorption problem.

Figure 9:
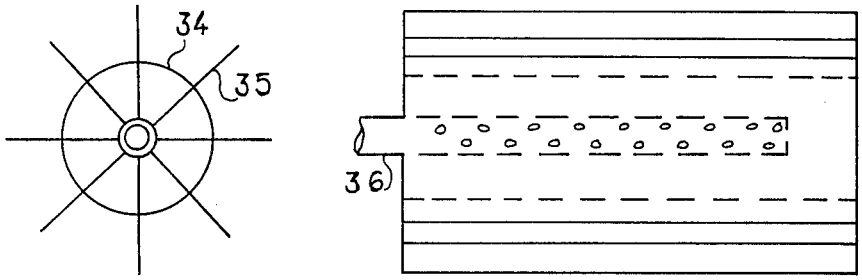
FIG. 9 shows a typical pressure vessel for the present invention with heat transfer fins.

In FIG. 9 is shown a pressure vessel 34 with fins 35 that extend clear into the air inlet/outlet pipe 36 as shown. End plates, adsorbent, and other details are not shown in FIG. 9.

That the present invention is new can be infered from the open literature. For example, in D. W. Breck's, *Zeolite Molecular Sieves*–John Wiley, on pages 675–676, we quote:

> "Typically it has been observed at low temperatures the adsorption of oxygen from air is inhibited in NaA zeolite by the slowly adsorbing nitrogen which blocks the active sites and crystal openings. This mechanism, although not as severe, is probably similar to that caused by the pre-adsorption of ammonia. When exposed to air at −183° C., the adsorbed phase in zeolite is greatly enriched in oxygen content to about 98% (volume). However, the rate of adsorption of oxygen from air at these temperatures is so slow that any separation based on this scheme is not practical."

Breck was looking for speed of adsorption which is important for real time separation systems. However, for the purpose of the present invention, the slow adsorption process is desired since slow adsorption means slow desorption. Speed of adsorption (charging the pressure vessel in the case of this invention) is only of secondary interest, since this charging process in general does not have a time premium placed on it.

DETAILED DESCRIPTION—II

The surface chemistry and physics of adsorption lie at the heart of the present invention. A new analysis tailored to the needs of the present invention has been developed in order to supplement the classical body of adsorption practice. A purely thermodynamic approach is taken and, therefore, no assumptions are required as to the mechanism of adsorption (chemical versus physical bonds, for example).

Figure 10:
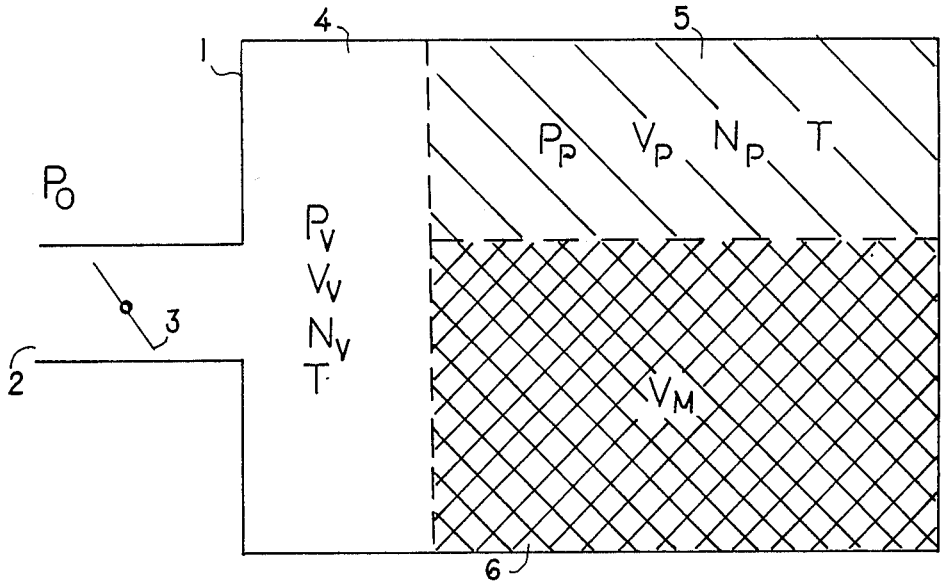
FIG. 10 represents a schematic of a gas receiving vessel.
Figure 11:
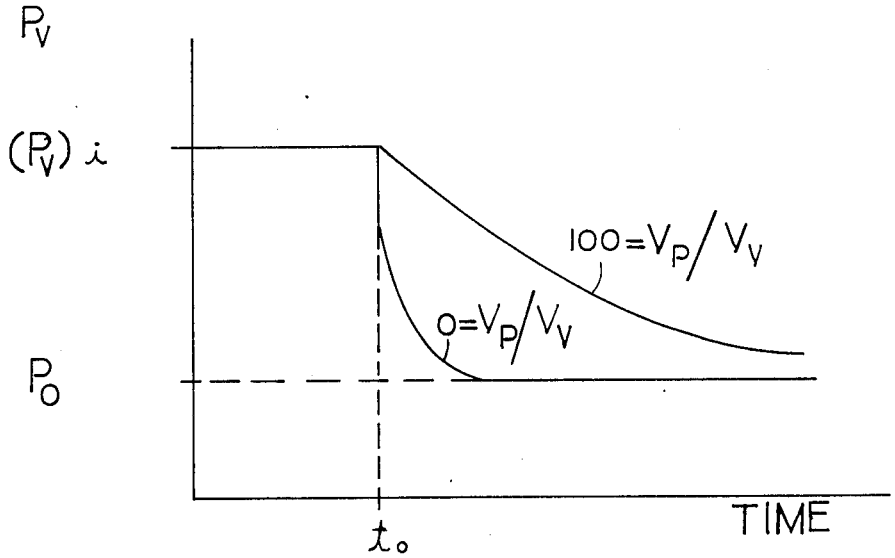
FIG. 11 is a plat of pressure versus time of adsorption in the vessel of FIG. 10.

FIGS. 10 and 11 are used to define the gas adsorption by solids for purposes of this invention. Pressure vessel 1 contains an inlet-outlet port 2 controlled by valve 3. The pressure vessel 1 contains a void volume 4 which contains $N_v$ moles of gas at pressure $P_v$ in volume $V_v$, and the perfect gas law is assumed to hold in this void space. The perfect gas law is stated in Chart 1 of this specification. Pressure vessel 1 also contains a solid adsorbing material which is described as follows. Typically, the adsorbent may be in the form of beads or crushed materials that contain a massive pore network. The volume of the pores is illustrated as the single cross-hatched area 5 in FIG. 1A, and contains $N_p$ moles of gas at gap pressure $P_p$ in a total pore volume $V_p$. The perfect gas law is assumed to "loosely" hold within the pores and this topic will be discussed in detail later in this specification. The inert mass of the adsorbent is shown as the double cross-hatched area 6 and acts only to take up space. It is understood that FIG. 1A is illustrative only—the distribution of pores, inert adsorbent material, and gas filled non-pore voids will be more or less uniformly distributed within pressure vessel 1. The gas filled void space ($V_v$) will include:

1. Any intentional voids that are desirable.
2. Dead gas space between the vessel walls and the adsorbent for situations where a "form fitting" body of adsorbent is cast inside the vessel.
3. Dead space between adsorbent pellets, when used. For spherical pellets, the space between pellets is about 26% of the total volume.
4. Practical void spaces in ports, valves, fittings, etc.

The adsorption process, for present purposes, is now defined with the aid of FIG. 10 and FIG. 11. The pressure vessel 1 is charged with a compressed gas until equilibrium occurs and all components and gases are at temperature T. The gas in the voids is $(P_v)_i$ and the valve 3 is open at t=0. Eventually, the pressure of the gas in the pressure void space, $P_v$, will equilibrate to ambient pressure, $P_o$. The time for $P_v$ to drop depends upon the retarding forces tending to hold the gas molecules in the pressure vessel. If no adsorbing materials are present in the vessel, then the response curve marked $V_p/V_v=0$ in FIG. 10 is applicable. The only forces to resist the exit of gas molecules in this case is the "bunching up" effect at the port 2 and evacuation is rapid. The curve marked $V_p/V_v=100$ in FIG. 11 shows the retarding effect due to the presence of a material containing adsorbing pores in the pressure vessel. This retarding force that tends to slow up the gas exit velocity for the situation described above is, in fact, taken to define the process whereby a solid material adsorbs a gas. The simple thermodynamic analysis to follow supplies a quantitative measure of adsorption on a first principles basis.

The above process of charging and evacuating the pressure vessel will now be repeated and quantitative relationships will be applied. Initially, gas under pressure is admitted to pressure vessel 1 and then the valve 3 is closed. The high pressure gas in void volume $V_v$ will force gas molecules into the pore volumes of the adsorbent, if the gas molecules are smaller than the pores. For the usual adsorbents and gases of interest, this includes all gas molecules. Eventually, a state of equilibrium will occur, wherein additional adsorption is accompanied by an equivalent desorption, on an average. The adsorption process leaves the gas molecules in a more ordered state and, therefore, the entropy of the gas phase has decreased. The free energy must be negative for the adsorption to occur and, therefore, heat must be given off by the second law of thermodynamics (Equation 1 in Chart 1). At equilibrium, no heat is given off or taken in, since the adsorption and desorption rates are equal, on the average. Excess heat of adsorption is evolved only during the initial transient period as excess adsorption occurs in order to establish new equilibrium conditions in response to the high pressure gas admitted to the pressure vessel 1.

The adsorbed gas molecule may be restricted in degrees of freedom such that a condensed-like state exists where vibration and rotation modes predominate over translational modes. The heat of adsorption for this case will be similar in magnitude to the heat of vaporization for the particular species. The gas is in equilibrium with its liquid phase with the adsorbent pore inbetween.

The gas molecule may be free to translate to some degree, while adsorbed in the pore, particularly if the pore is several tens of angstroms in diameter. In this case, the heat of adsorption will be less than the heat of vaporization for the particular gas species and a gas-gas state of equilibrium exists not unlike that of a membrane or capillary tube.

The adsorbed gas molecule may be tightly bound in the pore as if it were in the solid state. If the adsorbent-gas bond is similar to the molecular bond magnitude for the species in the solid phase, then the heat of adsorption will be about equal to the sum of the heat of vaporization and the heat of fusion for the particular species. In this case, the gas phase molecules in the pressure vessel void ($V_v$) are in equilibrium with their solid counterparts within the pores.

The adsorbed gas molecules may be more tightly bound to the adsorbent wall in the pore than they are to their own molecules in the solid state. In this case, the heat of adsorption will exceed the sum of the heats of fusion and vaporization for the particular species.

Different molecules of the same gas species may be adsorbed differently on the same adsorbing body or even within the same pore. For example, the first M molecules may be adsorbed such to form a monolayer uniformly distributed over the surface area of the pore. The next N molecules to be formed start to form a second monolayer on top of the first.

In summary, the heat of adsorption for any gas species on a solid adsorbent may be measured as anything from 0 Kcal/mole (Zero adsorption) up to some value that corresponds to the maximum chemical bond strength between the particular gas species and the adsorbent material that can exist. So called active sites are probably due to chemical and physical local irregularities that tend to adsorb gases more strongly than does the adsorbent as a whole. Most adsorption isotherms presented in the open literature represent differential adsorption and describe Langmuir adsorption.

Any value of heat of adsorption up to the limits of chemical bonding can, therefore, exist. However, certain preferred values must exist for the heat of adsorption for any given gasadsorbent combination: Adsorption heat equals vaporization heat or sum of fusion and vaporization heats. The particular model selected to describe the adsorption process is important for present purposes only in the fact that values for heat of adsorption will be required in the thermodynamic analysis to follow. For this purpose, the heat of adsorption as it appears in the open literature is presented in Chart 2 at the end of this specification, along with corresponding values for the heats of fusion and vaporization. In all cases, except carbon dioxide, the observed heat of adsorption exceeds the sum of the heats of vaporization and fusion. The carbon dioxide exception is probably due to the low critical temperature for that gas. Even so, most often the heat of adsorption for carbon dioxide exceeds the sum of its latent heats of fusion and vaporization.

The values in Chart 2 show very clearly the well-known fact that water is the most tightly bound of the common gases in the adsorbed state. The heat of vaporization, for example, is six times greater for water than for oxygen and is due to hydrogen bonding. The energy demands to "squeeze" together the hydrogen bonds must be satisfied in the adsorption process. Thus, water vapor is the most adsorbable of the common molecules.

A quantitative description of conditions existing inside the pressure vessel of FIG. 10 is available. After the compressed gas is admitted, a condition of equilibrium will be assumed after the heat of adsorption is evolved. The heat of adsorption must equal the free energy change which Equation 3 from Chart 1 furnishes:

$$\Delta G = H_A = RT \ln P_v/P_p$$

This equation can be rewritten in two useful forms:

$$\frac{P_v}{P_p} = e^{\frac{HA}{RT}}$$

$$\frac{N_p}{N_v} = \left(\frac{V_p}{V_v}\right) e^{-\frac{HA}{RT}}$$

All of the essential features describing the process called gas adsorption on solids are included in this equation. First, an exponential in terms of the ratio of adsorption energy to translational energy, i.e., $H_A/RT$ occurs analogously to the activation energy concept of classical chemical kinetics. The ratio of adsorbed to unadsorbed molecules, $N_p/N_v$, is seen to depend directly upon the pore volume to void volume ratio, $V_p/V_v$, and inversely upon the exponential. The physical significance of this result is clear. The higher the pore volume in relation to the void volume, the more molecules will be adsorbed. The higher the heat of adsorption relative to the translational energy RT, the fewer the molecules will be adsorbed.

The point of the present invention is to store as many gas molecules as is possible in a given size vessel while, at the same time, limiting the amount of instantaneous potential energy of compression in the gas to some acceptably safe value. The net effect must be to store more gas molecules in a cheaper, less strong pressure vessel than has been heretofore possible. This requirement demands a high gas density in the adsorbed phase and a relatively small potential energy of compression in the void volume, $V_v$. These essential aspects follow directly from the results derived above. It is necessary to calculate the total gas stored ($N_p+N_v$) in a given total physical volume ($V_p+V_m+V_v$). The compressed gas instantaneously available to escape (and, therefore, create damage to the vessel and surroundings) is that gas $N_v$ in void space $V_v$. This must be compared to an identical case where no adsorbent exists in the pressure vessel.

The required quantities of gas storage density and instantaneously available potential energy of compression must be calculated in terms of the following selectable design parameters:

$P_v$=Storage Driving Pressure in Void Space
$N_T$=Total Moles of Gas Stored=$N_p+N_v$
$V_T$=Total Vessel Volume=$V_v+V_p+V_m$
$V_p/V_v$=Pore to Void Volume Ratio for the Vessel-Adsorbent System
$V_p/(V_p+V_m)$=Pore to Material Volume Ratio for the Adsorbent Before proceeding to calculate the necessary quantities, it is important that the volume ratios be fully understood. The pore to material volume ratio, $V_p/V_p+V_m$, is given in Chart 3 for several commercial adsorbents, and is seen to be from about one-quarter to about one-third. The pore to volume ratio, $V_p/V_v$, is considerably more complex. If the adsorbent bed is closely packed spheres, then $(V_v/V_v)$=74%, since the volume ratio of spheres to voids in a closest packed hexagonal arrangement of equal sized spheres is $\pi/4.245$. This result is true for any size sphere until angstrom sized dimensions are reached. Consider the case where the adsorbent particles or the voids in case of a cast, one piece adsorbent body start to approach the prevailing gas phase molecule-molecule separation, $\bar{r}$. In this case, gas molecules will tend to hang up in the above described void and, therefore, a "loose" adsorption of perhaps 0.05 to 0.20 Kcal/mole (heat of adsorption) will take place. This loose adsorption, it will be seen, is adequate for the delaying action required for the present invention. In Chart 4 is tabulated the gas molecule average separation, $\bar{r}$, for oxygen at 100° C. For example, the average molecular separation is seen to be about 4.2 angstrom units at 500 atmospheres pressure. The manufacturing process then must be such to control the voids to less than about 10 angstrom in the case of an adsorbent body cast to form fit the vessel in order to satisfy the present invention in one embodiment. The undesirability of larger voids lies in the fact that pockets of gases in the voids will not be "adsorbed" and are, therefore, immediately free to escape as the pressure vessel is opened to atmosphere. The 10 angstrom limit placed upon void requirements in the adsorbent was for the case of maximum desorption time (or fast exit times for the gas molecules are minimized). That is the most possible practical delay of escaping gas to satisfy the needs of the present invention. In other cases, voids of 100 angstroms or more in the cast adsorbent may be permissible. This is particularly true for very large vessels with long physical dimensions, or where a high surface adsorption exists for the gas in question. The total volume in the pressure vessel and the total moles of gas stored can be written:

$$V_T = V_m + V_v + V_p = V_p\left[\left(\frac{V_m + V_p}{V_p}\right) + \frac{V_v}{V_p}\right]$$

$$N_T = N_p + N_v = \left[N_p 1 + \frac{N_v}{N_p}\right]$$

The total storage molar density, MT, then becomes for a high pore to void volume ratio:

$$M_T = \frac{N_T}{V_T} = \frac{N_p}{V_p}\left(\frac{V_p}{V_m + V_p}\right)\left(1 + \frac{N_v}{N_p}\right)$$

Combining this with previous results gives:

$$M_T = \frac{P_v}{RT}\left(\frac{V_p}{V_m + V_p}\right)\left[e^{-\frac{HA}{RT}} + \frac{V_v}{V_p}\right]$$

$$\simeq \frac{P_v}{RT}\left(\frac{V_p}{V_m + V_p}\right) e^{-\frac{HA}{RT}}$$

This last expression represents the total equivalent molar volume of gas contained in the pressure vessel. The analysis continues and then a detailed discussion of the physical significance of all the results will be presented.

For comparison, consider the situation where no adsorbent is in the pressure vessel, i.e., the prior art. The adsorbent free vessel must contain an equivalent amount of gas in the same physical volume for a valid comparison to be made. The storage pressure for the zero adsorbent case is less, since the adsorbent takes up physical space and, therefore, penalizes the present invention in this regard. Calling the storage gas pressure $P_{eq}$ for the zero adsorbent case, we have:

$$M_T = \frac{N_T}{V_T} = \frac{P_{eq}}{RT} = \frac{P_v}{RT}\left(\frac{V_p}{V_p + V_m}\right) e^{-\frac{HA}{RT}}$$

or, $$\frac{P_{eq}}{P_v} = \left(\frac{V_p}{V_p + V_m}\right) e^{-\frac{HA}{RT}}$$

The potential energy of compression that is of interest lies somewhere between that, if an adiabatic expansion occurs or if an isothermal expansion occurs. The isothermal case involves the logarithm of the pressure ratio times the gas constant R. The adiabatic case does not involve the gas pressure, but the gas constant, minus the heat capacity at constant volume, appears as a factor. A vessel failure process, wherein all the free gas molecules expand, will tend to be more adiabatic than isothermal. Therefore, the factor in the "rapid energy" expansion will be taken to be the gas constant R. It follows that:

$$\alpha = \text{Damage Improvement Factor}$$

$$= \frac{\text{Instantaneous gas energy available in this invention}}{\text{Instantaneous gas energy available in the prior art}}$$

$$= \frac{N_v RT}{(N_v + N_p)RT} = \frac{N_v}{N_v + N_p}$$

$$\alpha = \frac{1}{1 + \left(\frac{V_p}{V_v}\right) e^{-\frac{HA}{RT}}}$$

We now are in a position to discuss the physical significance of the above results.

Figure 12:
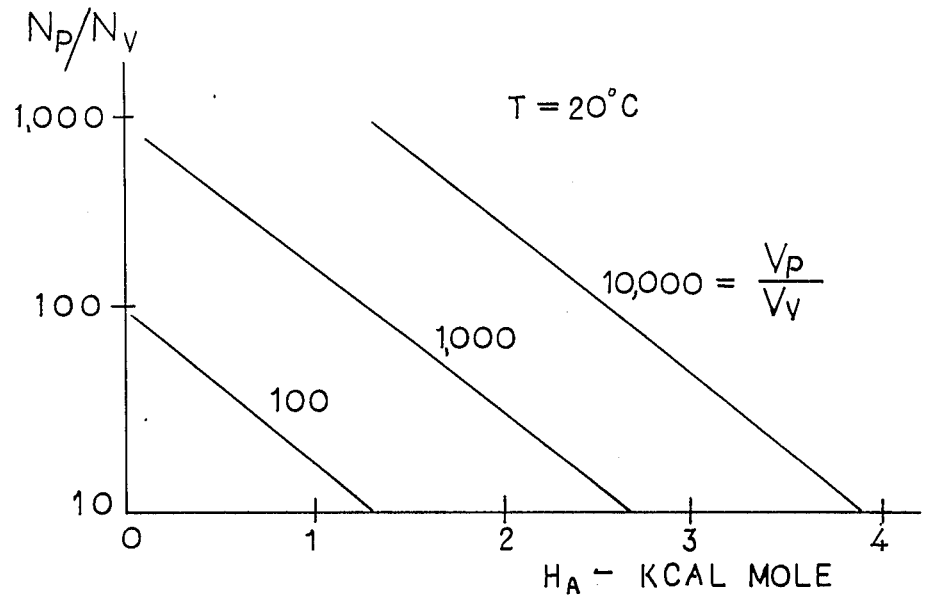
FIGS. 12–21 are various plats of physical parameters relating to gases and the adsorption process.

The prior results were used to plot the results shown in FIG. 12, FIG. 13, FIG. 14, FIG. 15, and FIG. 16. FIG. 12 shows the ratio of the number of moles of gas in the pores to the number of moles in the void, $V_p/V_v$; that is, the fraction adsorbed. For example, an adsorbent with 1000 times more pore volume than void volume ($V_p/V_v = 1000$) and a heat of adsorption of 2 Kcal/mole will have about 30 times more moles in the pores than in the voids. FIG. 12 is plotted for 20° C. and applies to any ideal gas.

Figure 13:
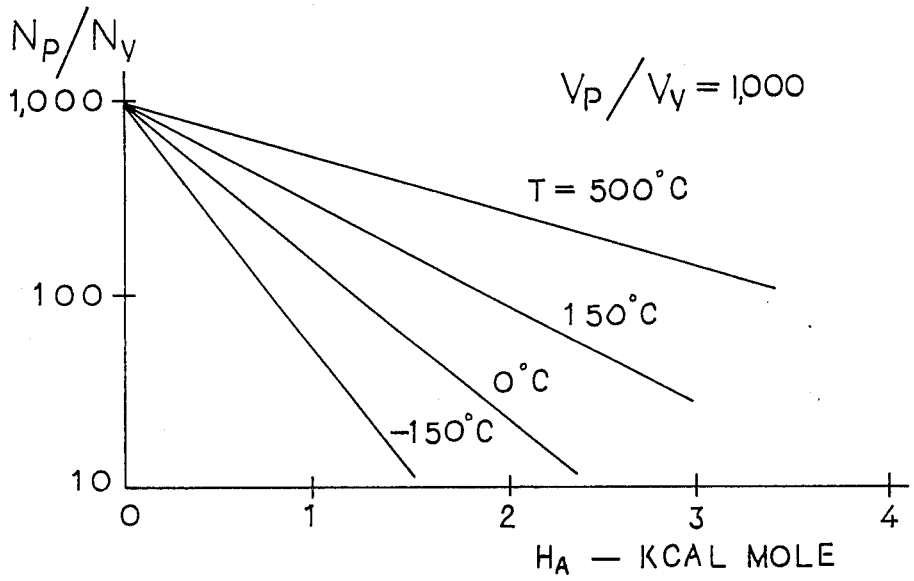

FIG. 13 presents the same data as FIG. 12, except the pore to void volume ratio is held at 1000 and the temperature is allowed to assume various values. Very clearly, the hotter the gas, the higher the adsorbed moles at equilibrium.

Figure 14:
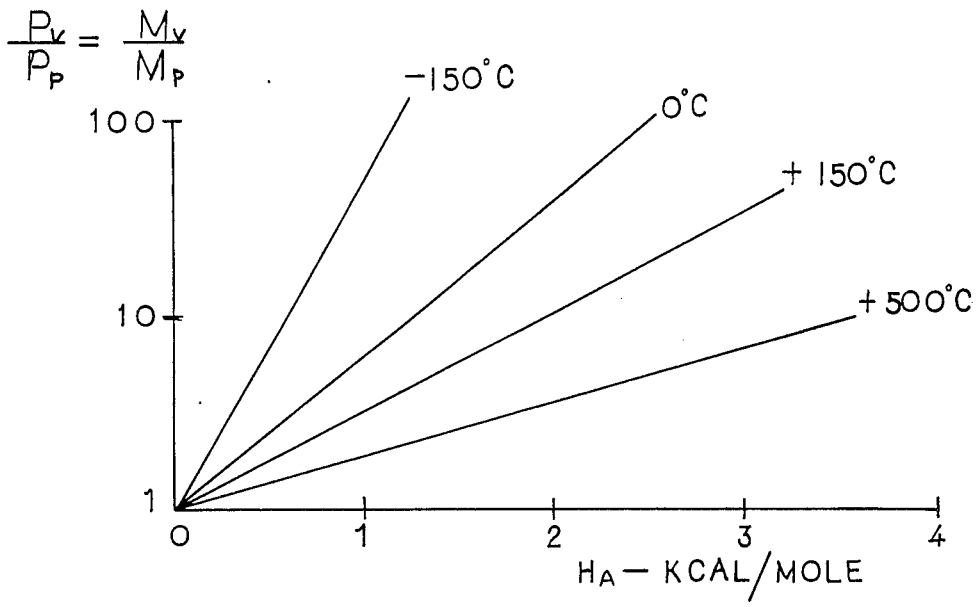

FIG. 14 is essentially the same data, except the ratio of the void to adsorbed gas pressure is plotted as well as the molar volume ratio for the unadsorbed and adsorbed gas. This again shows the benefit of high gas temperatures.

Figure 15:
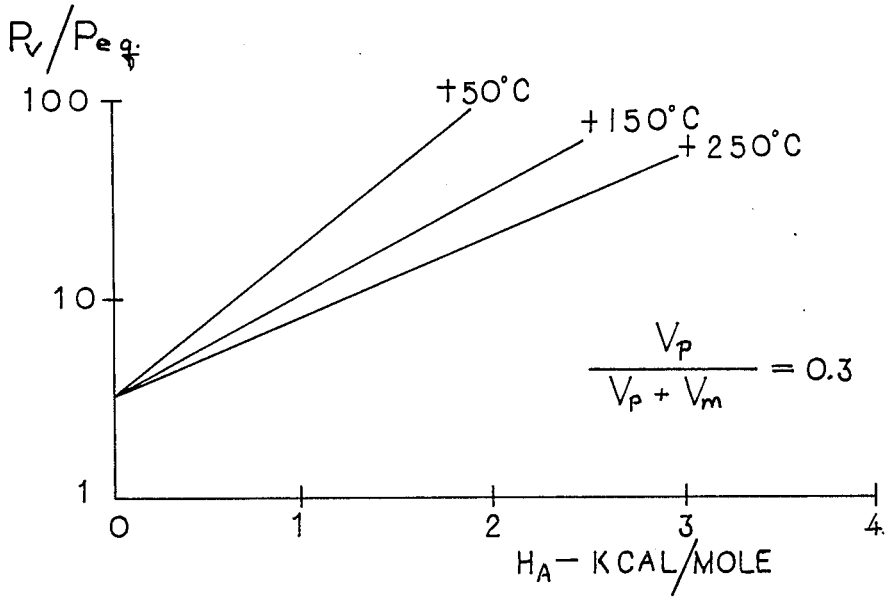

FIG. 15 is used to compare the present invention to the prior art in regard to highest pressure in the vessel. The highest vessel pressure for the present invention is $P_v$ and represents the small amount of unadsorbed gas in the voids. $P_{eq}$ represents the gas pressure that would be required to store an equivalent amount of gas in an equivalent volume if no adsorbent were used. For example, with a heat of adsorption of 2 Kcal/mole and a gas temperature of 250° C., the present invention requires a gas pressure of about 20 times the prior art case ($P_v/P_{eq} \simeq 20$).

Figure 16:
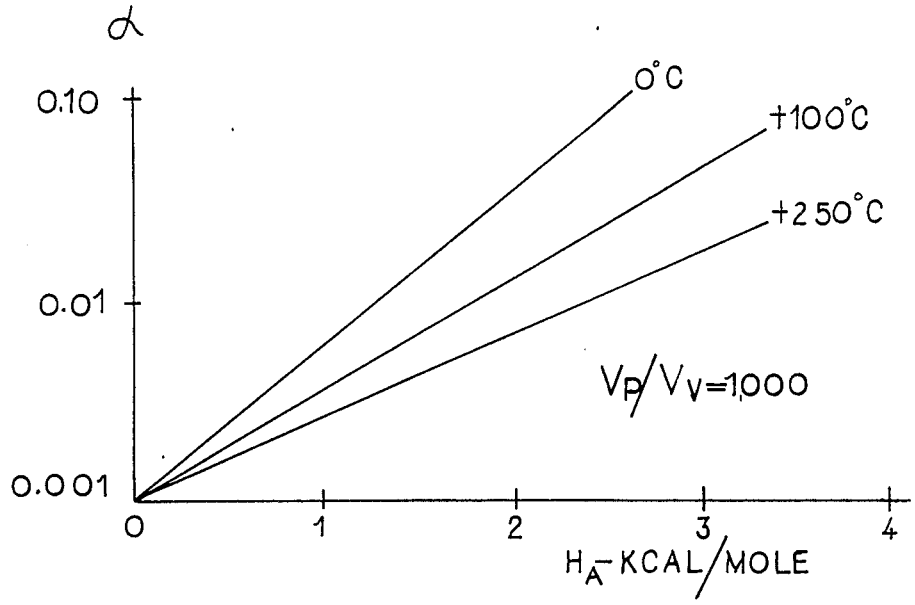

FIG. 16 summarizes the present invention. Even though the present invention calls for a higher gas pressure, the system is much safer than the prior art, since much less gas is available for rapid expansion in case of a pressure vessel failure. The damage reduction factor is on an energy basis. For example, a 2 Kcal/mole heat of adsorption at 250° C. shows less than 1% of the prior art "quick release available energy". This massive induced safety factor leads to a simpler, safer, and cheaper pressure vessel for storing compressed gases. Consider, for example, the storage of 10,000 moles of gas at 20° C. The internal energy of the gas is:

$$\xi = 1.987 \times 10^3 \frac{\text{Kcal}}{\text{Mole °K.}} \times 10{,}000 \text{ Moles} \times 293\text{° K.}$$

$$= 5.82 \times 10^3 \text{ Kcal} = 23{,}000 \text{ Btu}$$

This energy, equivalent to one pound of gasoline, is available to be released instantaneously if the vessel is fractured. The embodiment of the present invention with the $=1\%$ example just discussed would only have to manage 230 Btu if the vessel were to fracture. In fact, vessel failure for the present invention provides some additional safety factors. Initially, upon rupture of the pressure vessel, only that gas in the void volume, $V_v$, is free to expand immediately and cause physical damage. The main portion of the gas is adsorbed on the adsorbent and must, therefore, be desorbed prior to any damage producing expansion it can undergo. Heat must be supplied for the desorption and can only be supplied by the ambient environment, i.e., the atmosphere. This heat transfer takes time, which further moderates the situation. Considerable frosting (for humid conditions) and cooling of the adsorbent and surrounding bodies will further slow things down. As the gases come out of the adsorbent, a reverse physical reaction, via Newton's law of motion, will occur on the adsorbent as a free body. This reverse jet reaction will tend to keep the adsorbent together rather than sending it out initially as shrapnel.

The beneficial effects of high adsorption at high temperatures shown in FIGS. 13 through 16 are not in conflict with classical adsorption isotherms that always show a decrease in adsorbed gas, at equilibrium, with increased temperature. Consider, for example, FIG. 13. The isotherm here is not a real world situation, since the heat of adsorption is constantly changing on the isotherm. There is no direct way of comparing the data in FIG. 13 to that of a classical adsorption isotherm by inspection. In fact, the present invention was a direct result of analyzing the non-standard plots of FIGS. 12 through 16.

Only ideal gases obeying the perfect gas law have been considered thus far in this specification. However, well-known deviations from ideal behavior have long been observed. The present invention depends, in part, upon these deviations, and this dependency is analyzed next.

Gases at high pressures reach a limit of compressibility when the molecular separations approach the physical dimensions of the molecule. Van der Waal's equation more or less accurately describes conditions as they exist at high pressures and/or low temperatures. The Van der Waal equation of state takes into account the gas molecule size and the molecule to molecule forces that exist for small separations. The equation is complex and depends upon the particular gas under consideration. An alternate, simpler, and more useful attack is to define a compressibility factor Z as follows:

$$PV = ZRT$$

Z is taken to mean that the gas pressure for a given set of conditions is higher than the ideal gas counterpart. The value of Z depends upon the particular gas, especially the critical pressure and temperature of the gas. The oxygen molecule being typical will be analyzed in this specification, but this is not to be taken to mean that the invention applies only to oxygen. A similar analysis will yield correspondingly similar results for other gases to which the present invention equally applies.

Figure 17:
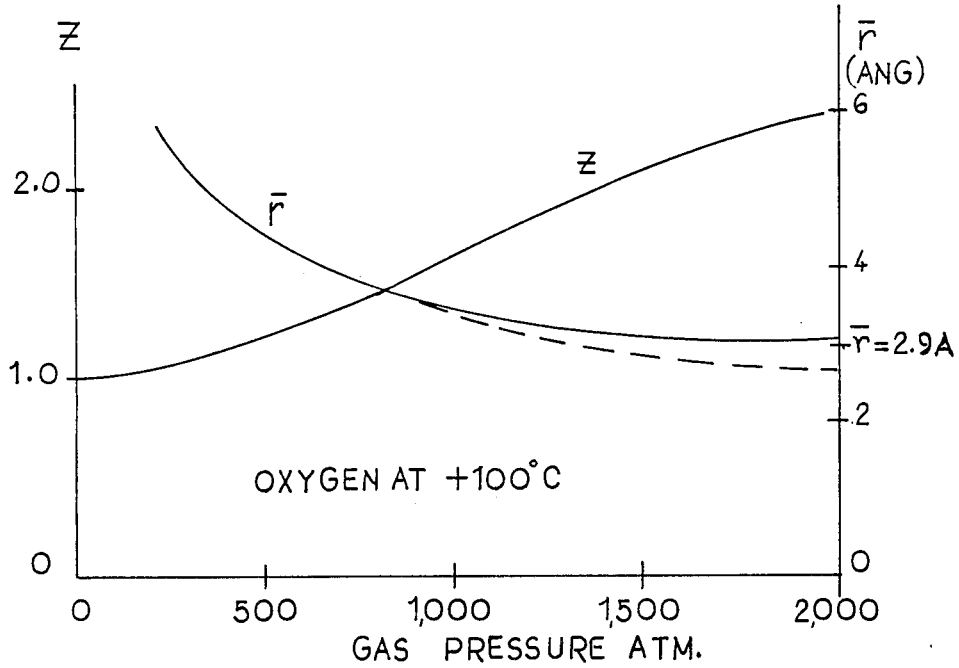
Figure 18:
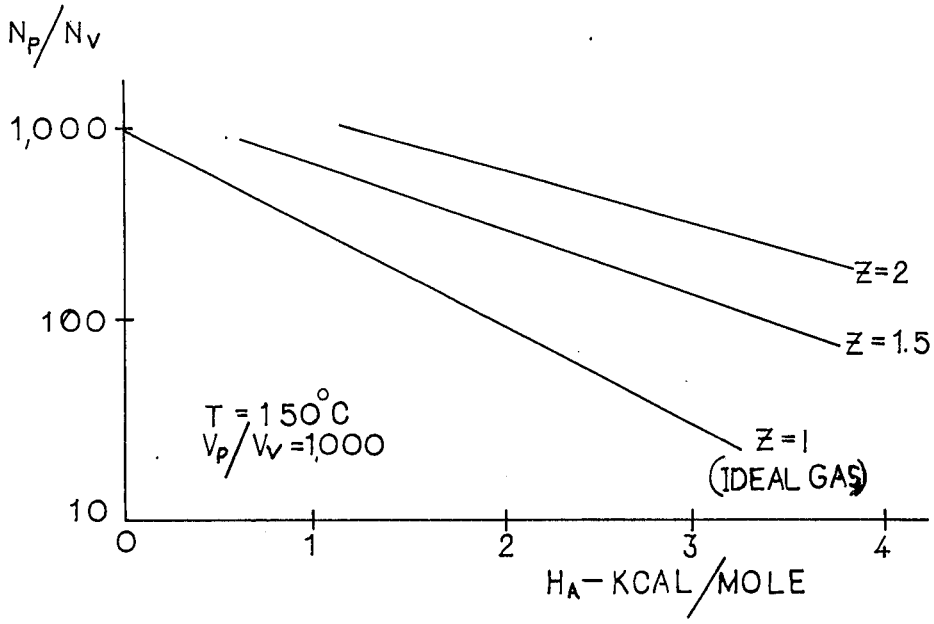

FIG. 17 shows the molecule-molecule separation, $\bar{r}$, for gaseous oxygen along with the compressibility factor, Z. Deviations from the perfect gas law in FIG. 17 (dashed curve) start to show up to about 1000 atmospheres of gas pressure. The compressibility factor, Z, becomes significant at gas pressures greater than about 500 atmospheres.

If Z does not change too rapidly with pressure, the free energy during the adsorption process may be written:

$$\Delta G = H_A = \int_{P_v}^{P_p} PdV = \int_{P_v}^{P_p} - VdP = \int_{P_v}^{P_p} - ZRT\frac{dP}{P}$$

$$= ZRT \ln P_p/P_v$$

Physically, the Z factor acts just like a temperature increase and is beneficial for the present invention. At gas pressures, when Z becomes significant, the gas molecules just cannot be squeezed any closer together. Additional increases in pressure have little effect upon gas volume, but the extra pressure is effective in squeezing molecules into the adsorbent pores and, thereby, satisfying the extra free energy required by the above equation. In short, the highly compressed gas with a high Z factor acts like a constant pressure source in regard to the adsorption process. This process will be limited at some point as the desorption forces become large as a result of the extreme density of the adsorbed gas. The ratio of adsorbed to unadsorbed molecules becomes:

$$\frac{N_p}{N_v} = \frac{ZV_pP_p}{V_vP_v} = Z\frac{V_p}{V_v}e^{-\frac{HA}{ZRT}}$$

FIG. 13 is redrawn for the purpose of showing the beneficial effects, for purposes of this invention, of gas compressibility. The benefit of gas compressibility is very clear. For example, the amount of gas adsorbed is increased by about a factor of ten at 3 Kcal/mole heat of adsorption for the case shown.

The previously computed molar volume becomes:

$$M_T = \frac{P_v}{RT}\left(\frac{V_p}{V_m + V_p}\right)e^{-\frac{HA}{ZRT}}$$

The molar volume, $M_T$, can be shown to have a maximum by equating the derivative to zero. There results:

$$RT = \frac{Z}{H_A} \text{ For Maximum Density}$$

The equivalent pressure for the zero adsorbent case and the damage improvement factor can be written:

$$\frac{P_{eq}}{P_v} = \left(\frac{V_p}{V_p + V_m}\right)e^{-\frac{HA}{ZRT}}$$

$$\alpha = \frac{Z}{1 + Z\left(\frac{V_p}{V_v}\right)e^{-\frac{HA}{ZRT}}}$$

Figure 19:
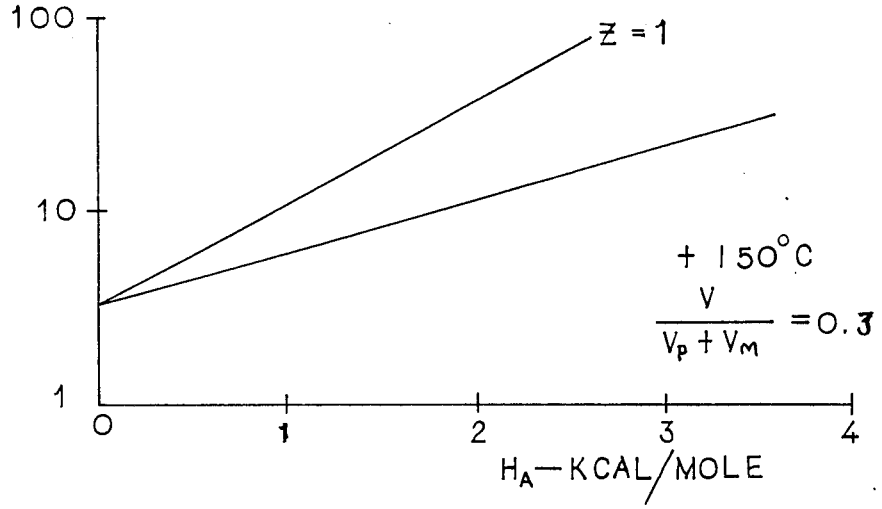
Figure 20:
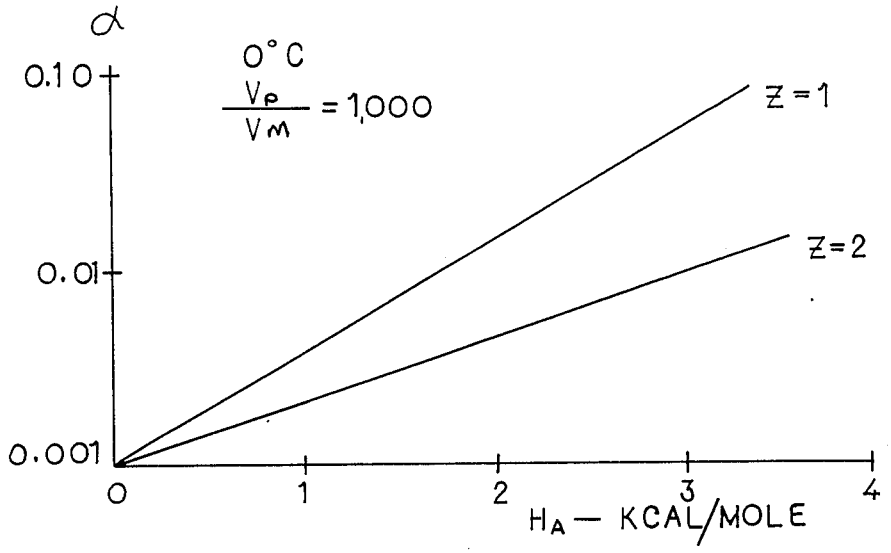

These results are plotted in FIG. 19 and FIG. 20 and the beneficial effects of the compressibility factor Z is very clearly seen. This represents one of the few times that a normally undesirable or parasitic effect can be put to useful purposes.

Figure 21:
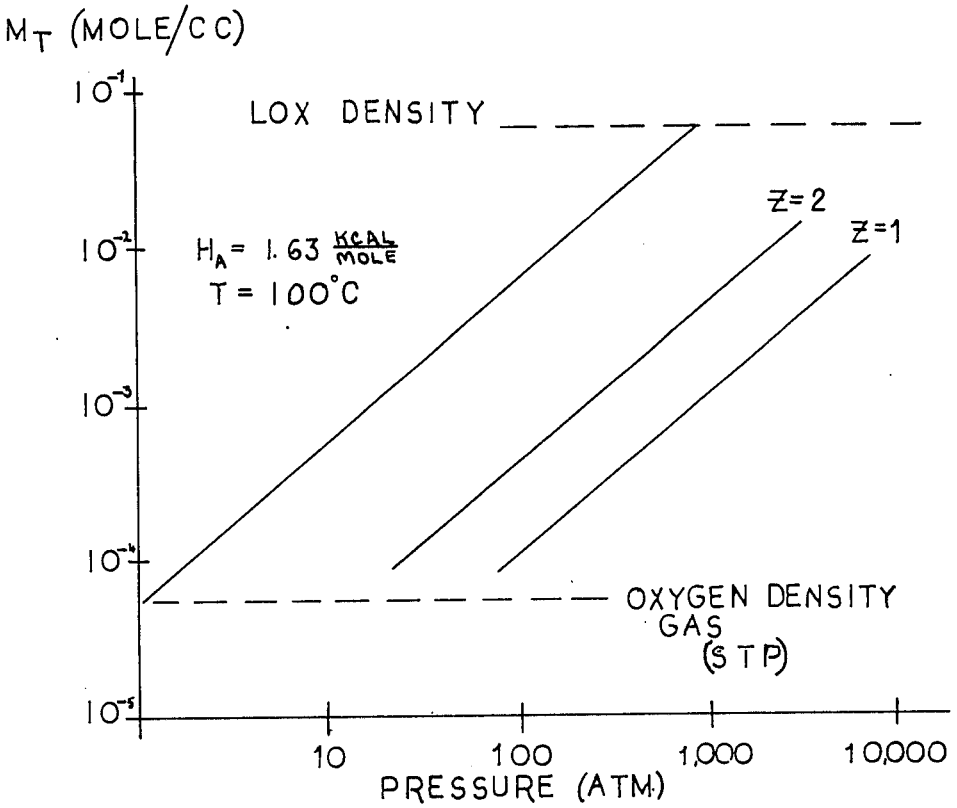

FIG. 21 presents the actual gas storage density utilizing the teachings of the present invention for the case of oxygen. The heat of adsorption assumed is the heat of vaporization for oxygen, i.e., 1.63 Kcal/mole. A 100° C. temperature was assumed. The standard gas density and liquid oxygen densities (LOX) are shown for comparison. Consider a 2000 atmosphere pressure. A compressibility of Z=2 applies and a net storage density of about 0.01 moles per cubic centimeters is read from the curve. The 0.01 moles per cubic centimeter storage density is about 20.8% of the density of liquid oxygen and 240 times the density of standard oxygen.

Another major benefit occurs under the high pressure teachings of the present invention. Gases like oxygen and nitrogen are not very well adsorbed in prior art systems at the relatively low gas pressures used (usually only one or two atmospheres). The saturated vapor pressure for oxygen at 100° C. is about 110 atmospheres and the saturated vapor pressure for nitrogen is about 95 atmospheres at 100° C. These high vapor pressures make it difficult to force the molecules into the pores and tend them towards the liquid phase. The situation is even worse, since the vapor pressure of a drop of liquid is greater than for a plane of liquid in equilibrium with vapor. Lord Kelvin derived the relationship between droplet size and vapor pressure and the results are known to occur almost exactly as predicted. The Kelvin equation is given in Chart 1 as Equation 5 and the results are plotted in FIG. 22 for oxygen. A value for $\alpha$, the surface tension, of 15.7 dynes per centimeter was assumed along with a gas temperature of 293° C. This amounts to assuming that the adsorbed oxygen has essentially the same surface tension as liquid oxygen. The results in FIG. 22 indicate an oxygen vapor pressure of about 400 atmospheres at a droplet size corresponding to an oxygen molecular diameter. A more realistic droplet size in the pore might be in the 4 to 8 angstrom range. In any event, the high vapor pressure associated with adsorbed oxygen and nitrogen makes them poor gases to adsorb at the low pressures of the prior art practices.

Generalized compressibility charts in the open literature indicate that for pressures greater than about 8 times the critical pressure for a given gas, the compressibility factor is always greater than 1. The preferred embodiment of the present invention is to operate at gas pressures greater than about 8 times the critical pressure for the particular gas or mixtures of gases. Chart 5 gives a list of critical pressures for some typical gases of interest to this invention. That is not to say that the present invention does not apply at gas pressures less than 8 times the critical pressure. In some applications, a gas pressure of one or two times the critical gas pressure, or even less, may be desirable. In many cases, a mixture of gases may be stored in the same vessel and share the same adsorbing body.

The Z factor (compressibility) in the above discussion applies when the driving gas pressure ($P_v$) is governed by compressibility effects, but the adsorbed gas ($P_p$) is not. As the adsorbed gas approaches a sufficient density, then an additional Z factor must be applied and the free energy equation corrected accordingly. By FIG. 14, this will occur only at low heat of adsorptions and high temperatures. A typical situation might be where the adsorbed gas is loosely held in voids in the adsorbent bed and when heat is supplied to the vessel.

Adsorption and desorption times are known to be high (minutes or hours) for high density (low void) adsorbents. Therefore, high density adsorbents are avoided in the manufacture of molecular sieves, carbon, and the like. However, long adsorption times do not seriously limit or restrict the present invention, and long desorption times are, of course, the heart of the invention. The longer the desorption time, the longer the time available to dissipate the potential energy of compression in the stored gas.

A typical process history for the present invention is the following:

1. Charge the adsorbent filled pressure vessel with product gas.
2. Store the product gas in the pressure vessel for some specified time up to and including months or years.
3. Draw off the product at some specified rate. Minutes to days may be required to empty the vessel.
4. Recharge the adsorbent filled pressure vessel with a new lot of product gas.

It may be desirable to supply energy for any or all of the three basic steps of fill, store, and product draw. For example, the pressure storage vessel may contain a heater to constantly warm the adsorbent bed. The entire vessel may be thermally insulated from the environment to save heat. The heat may be applied via heaters imbedded in the adsorbent or an electrical current may be passed through the adsorbent bed, thereby supplying $I^2R$ heating directly to the adsorbent. Iron particles in the adsorbent bed or, in fact, iron tied up chemically in the adsorbent bed will allow induction heating methods to be utilized.

Ultrasonic energy may be applied directly to the adsorbent bed to "dither" the gas molecules into a close packed arrangement during the filling process. Heat added during the filling process can speed up the operation.

The nature of the present invention is to provide a relatively long desorption time, preferably on the order of minutes to hours. In some applications, this may be severely limiting in situations where a fast product draw is essential. Submarine blow-down is one example. In this case, an extremely large, short burst of electrical energy ($I^2R$ in the adsorbent itself where R is the bulk resistivity of the adsorbent) applied to the bed will expedite the fast draw process.

In some cases, a simple low density, highly porous plastic material, such as styrofoam, packed in the gas storage vessel will provide an additional factor of safety up and above the usual precautions taken. The styrofoam cells will not provide the delay an adsorbent (in the usual sense) such as carbon, coal, or molecular sieves will, but fast exit of the gas, upon vessel rupture, will be slowed down. Chart 6 is a more or less complete list of adsorbents that can be used with the present invention. New adsorbents are continually being available. High density adsorbents, particularly manufactured molecular sieves, have found no use in the past, due to the slow adsorption times. These materials will find new favor in conjunction with the present invention.

The book, *Molecular Sieves,* by Hersh and published by Reinhold, shows some data in support of the present invention. On page 89 of Hersh, we see a 5 minute (plus) adsorption time for nitrogen on Type A molecular sieve. Since desorption times must be similar to adsorption times, other factors being equal, a Type A molecular sieve provides the size delay times required by this invention.

EXAMPLE 1

In one application, a submarine air tank of 1000 cubic feet capacity is filled with 13X molecular sieve of 8.4 angstrom pore diameter. A pore to void ratio of 1500 is achieved. Heaters inside the bed maintain a constant temperature of 50° C. An average molar density of storage of 0.01 moles/cc is achieved at a gas pressure ($P_v$) of 1000 atmospheres. The damage improvement factor is estimated to be 0.005, that is, the expected energy for damage is about 1/200th. what would be expected with no adsorbent in the pressure vessel.

EXAMPLE 2

An in-ground storage tank of 1 million cubic feet volume is filled with closely packed carbon (activated) and natural gas of pressure amounting to 500 atmospheres is stored. The cost and complexity of the storage system is found to be about 40% less than is available by prior art high pressure ground storage methods.

EXAMPLE 3

A locomotive stores 10,000 pounds of oxygen in a 500 cubic foot vessel with a form cast adsorbent of 10X molecular sieve (7.8 angstrom pore). Insulation and thermal heating was applied to the vessel. A damage improvement factor, estimated to be about 100:1 ($\alpha=0.01$) is realized.

EXAMPLE 4

A system similar to Example 3 of 1000 pounds capacity is built for truck service on the highway. Filling is expedited by the use of ultrasonic energy applied to the adsorbent bed.

EXAMPLE 5

A system similar to Example 3 where the system is charged by cryogenic liquid oxygen and sealed. Equilibrium pressures are achieved by liquid evaporation and the damage improvement factor estimated at ($\alpha=0.01$) compared with a non adsorbent system.

EXAMPLE 6

The stored energy in Example 3 is drawn off in a controlled manner to drive a 50 H.P. air motor. Both piston and rotary type motors are run with equal ease.

CHART 1

Basic Equations, Definitions, and Symbols

1. $\Delta G = \Delta T - T\Delta S$
2. $PV = ZRT$
3. $\Delta G = RT \ln K_{12}$
4. $\xi_c = NRT \ln P_2/P_1$ (isothermal)
5. $\xi_c = \left(\frac{NRT}{\alpha - 1}\right)_{max.}$ (adiabatic)
6. $\frac{P_{uAp}}{(P_{vAp})0} = \frac{2M\gamma_0}{RT\rho r}$ P = Gas pressure (various units as convenient)
V = Gas volume (various units as convenient)
T = Temperature - °K.
R = Universal Gas constant
= $1.987 \times 10^{-3}$ Kcal/mole per °K.
= 80.0 C.C. - Atm. per mole - °K.
$\Delta G$ = Free energy change - Kcal/mole
Z = Compressibility factor
$\Delta S$ = Entropy change - Kcal/mole - °K.
$\xi_c$ = Energy of compression (various units as convenient)
$\alpha$ = Specific heat ratio for gas.
$K_{12}$ = Equilibrium constant for states 1 and 2
$\bar{r}$ = Average molecule-molecule separations - angstroms
$\bar{r}_0$ = Average gas molecule diameter
$P_c$ = Critical pressure - atmospheres
$H_A$ = Heat of adsorption - Kcal/mole
$\gamma_0$ = Surface tension - dynes/cm.
$\rho$ = Density - Gm/Cm$^3$
r = Radius of Drop - cm.

Subscript V - Applies to void space in pressure vessel occupied by unadsorbed gas.
Subscript P - Applies to pore volume in adsorbent
Subscript M - Applies to volume of non-pore (solid) portion of adsorbent.

Equations to be found in any Physical Chemistry Text. See, for example, Moore—*Physical Chemistry,* Prentice Hall.

CHART 2

| Species | $H_v$ | $H_f$ | $H_v + H_f$ | H |
|---|---|---|---|---|
| $O_2$ | 1.63 | 0.11 | 1.74 | 3.3–4.6 |
| $N_2$ | 1.34 | 0.17 | 1.51 | 4.2–6.5 |
| $H_2O$ | 9.73 | 1.50 | 10.23 | 13.0–22.5 |
| Ar | 1.57 | 0.29 | 1.86 | 1.9–2.8 |
| $H_2$ | 0.22 | 0.03 | 0.25 | 1.4–4.0 |
| CO | 1.44 | 0.20 | 1.64 | 5.4–5.6 |
| $CO_2$ | 6.03 | 1.90 | 7.93 | 7.3–11.0 |

-continued

CHART 2

| Species | $H_v$ | $H_f$ | $H_v + H_f$ | H |
|---|---|---|---|---|
| $NH_3$ | 5.58 | 1.35 | 6.93 | 13.9–28.6 |
| $CH_4$ | 2.04 | 0.22 | 2.26 | 4.2–5.2 |

All quantities in Kcal/mole.
$H_v$, $H_f$ = Heats of vaporization and fusion from chemical engineer's handbook.
$H_A$ = Heat of adsorption for various sets of conditions from Zeolite Molecular Sieves, Breck, John Wiley.

CHART 3

| Commercial Adsorbent | Pore Diameter | $\frac{V_p}{V_p + V_m}$ |
|---|---|---|
| Silica gel - Davison Chemical | 22 | 0.34 |
| Molecular sieves - Davison | 3,4,5,10 | 0.22–0.24 |
| Sorbeads "R" Mobile Oil | 22 | 0.29 |
| Activated Aluminas | | |
| F-1 Alcoa | 26 | 0.22 |
| H-151 Alcoa | 43 | 0.32–0.34 |
| KA-101 Kaiser Aluminum | 41 | 0.29 |
| Florite - Floridin Co. | 50 | 0.39 |

Pore Diameter in angstroms
From Fluid Processing Handbook, W. R. Grace.

CHART 4
DENSITY

| Species | Liquid | Gas |
|---|---|---|
| Oxygen | 0.0483 | $4.16 \times 10^{-5}$ |
| Nitrogen | 0.0227 | $3.64 \times 10^{-5}$ |
| Air | 0.0254 | $3.77 \times 10^{-5}$ |

Moles/CC at 20° C. for gas.
Moles/CC at B.P. for liquid

CHART 5
CRITICAL PRESSURES FOR TYPICAL GASES

| Gas | $P_c$ |
|---|---|
| Air | 37.2 atm. |
| $NH_3$ | 111.5 |
| A | 48.0 |
| $CO_2$ | 73.0 |
| Ne | 2.26 |
| $H_2$ | 12.8 |
| Kr | 54.3 |
| $CH_4$ | 45.8 |
| Ne | 25.8 |
| NO | 65.0 |
| $N_2$ | 33.5 |
| $N_2O_4$ | 100.0 |
| $N_2O$ | 71.7 |
| $O_2$ | 49.7 |
| Rn | 62.0 |
| $SO_2$ | 77.7 |
| Xe | 58.2 |

CHART 6
TYPICAL NATURAL AND MANUFACTURED ADSORBENTS

| | |
|---|---|
| Aluminosilicates (Molecular Sieves) | Laumonite |
| Activated Alumina | Levynite |
| Activated Bauxite | Metathomsonite |
| Silica Gel | Mesolite |
| Magnesium Perchlorate | Natrolite |
| Calcium Sulfate | Scolecite |
| Raney Nickel | Mordenite |
| Plastic Foams | Natrolite |
| Coal | Phillipsite |
| Carbon | Scolecite |

-continued

CHART 6
TYPICAL NATURAL AND
MANUFACTURED ADSORBENTS

| | |
|---|---|
| Activated Charcoal | Staurolite |
| Mordenite | Stilbite |
| Analcime | Thomsonite |
| Clinoptilolite | Zoisite |
| Analcite | Synthetic Zeolites |
| Brewsterite | A |
| Cancrinite | N-A |
| Chabazite | ZK-4 |
| Edingtonite | X |
| Epistilibite | Y |
| Erionite | ZK-5 |
| Faujasite | L |
| Gismondite | Le-A |
| Gmelinite | F |
| Harmotome | Z |
| Heulandite | H |
| Le-H | |
| J | |
| E | |
| M | |
| Q | |
| W | |
| N | |
| ZSM-2 | |
| ZSM-3 | |
| ZSM-4 | |
| ZSM-5 | |
| ZSM-10 | |
| BETA | |

-continued

CHART 6
TYPICAL NATURAL AND
MANUFACTURED ADSORBENTS

| |
|---|
| Z-21 |

What is claimed is:

1. An engine system including a combustion engine and an oxidizer subsystem for high density gaseous oxidizer, said oxidizer subsystem comprising:

a storage vessel;

adsorbent material in said storage vessel capable of adsorbing relatively large volumes of said gaseous oxidizer at ambient temperature and of preventing the instantaneous release thereof in the event of a rupture of said vessel, said storage vessel being operatively connected for delivery of oxidizer to said engine for combination with fuel therein to power said engine.

2. A combustion engine system as defined in claim 1 further including flow control means to control the rate of discharge of said oxidizer from said storage vessel.

3. A combustion engine system as defined in claim 2 further including pressure control means to control the pressure of discharge of said oxidizer from said storage vessel.

4. A combustion engine system as defined in claim 2 in which said flow control means includes an electrodesorption device operatively connected to said storage vessel.

5. A combustion engine system as defined in claim 3 in which said pressure control means includes an electrodesorption device operatively connected to said storage vessel.

* * * * *